US008232520B2

(12) United States Patent
Cristoni

(10) Patent No.: US 8,232,520 B2
(45) Date of Patent: Jul. 31, 2012

(54) IONIZATION SOURCE APPARATUS AND METHOD FOR MASS SPECTROMETRY

(75) Inventor: Simone Cristoni, Zola Predosa (IT)

(73) Assignee: I.S.B.—Ion Source & Biotechnologies S.r.l., Milan (IT)

( * ) Notice: Subject to any disclaimer, the term of this patent is extended or adjusted under 35 U.S.C. 154(b) by 448 days.

(21) Appl. No.: 12/300,190

(22) PCT Filed: May 9, 2007

(86) PCT No.: PCT/EP2007/004094

§ 371 (c)(1),
(2), (4) Date: Mar. 26, 2009

(87) PCT Pub. No.: WO2007/131682

PCT Pub. Date: Nov. 22, 2007

(65) Prior Publication Data

US 2010/0012830 A1 Jan. 21, 2010

(30) Foreign Application Priority Data

May 11, 2006 (EP) ..... 06009717

(51) Int. Cl.
*H01J 49/00* (2006.01)

(52) U.S. Cl. ..... 250/288; 250/281; 250/282; 250/423 R; 250/424; 250/425; 250/426; 250/427; 250/423 P; 250/423 F

(58) Field of Classification Search ..... 250/281, 250/282, 288, 423 R, 424, 425, 426, 427, 250/423 P, 423 F See application file for complete search history.

(56) References Cited

U.S. PATENT DOCUMENTS

| | | | | |
|---|---|---|---|---|
| 4,570,068 | A | 2/1986 | Sakairi et al. | |
| 5,259,254 | A | 11/1993 | Zhu et al. | |
| 2004/0217281 | A1 * | 11/2004 | Bai et al. | 250/288 |
| 2005/0230635 | A1 * | 10/2005 | Takats et al. | 250/424 |
| 2006/0038122 | A1 | 2/2006 | Linden | |
| 2006/0289782 | A1 * | 12/2006 | Fischer | 250/423 F |

FOREIGN PATENT DOCUMENTS

| | | |
|---|---|---|
| EP | 0 715 337 | 6/1996 |
| EP | 0 964 427 | 12/1999 |
| WO | 2004/034011 | 4/2004 |

OTHER PUBLICATIONS

International Search Report dated Mar. 19, 2008, from corresponding PCT application.

* cited by examiner

*Primary Examiner* — Michael Maskell
*Assistant Examiner* — Hanway Chang
(74) *Attorney, Agent, or Firm* — Young & Thompson

(57) ABSTRACT

The invention provides an ionization source for mass spectrometers named Universal Soft Ionization Source (USIS), wherein the ionization chamber combines various physical effects including InfraRed and UltraViolet normal or laser light, ultrasound, electrostatic potential and differential temperature to analyze polar, non-polar, low, medium or high molecular weight molecules, in order to ionize a variety of compounds.

19 Claims, 13 Drawing Sheets

IONIZATION SOURCE APPARATUS AND METHOD FOR MASS SPECTROMETRY

FIELD OF THE INVENTION

This invention relates to the field of mass spectrometry, and more particularly to an apparatus and method that makes possible to ionize different chemical compounds by means of a unique ionization source, allowing a strong improvement in terms of sensitivity compared to the ordinary Electrospray (ESI) and Atmospheric Pressure Chemical Ionization (APCI) Techniques.

BACKGROUND OF THE INVENTION

Mass Spectrometry is a wide diffuse technology for the analysis of various polar and not polar compounds. In particular, Liquid Chromatography has been employed in the analysis of compounds with different polarity degree and molecular weight. The characterization and quantitation of these compounds are, in fact, of interest and new methodologies are continuously developed for their analysis. In the recent years various technologies have been developed for analyzing various molecules by Mass Spectrometry. For example, the analysis of addict drugs is one of the recent fields where Liquid chromatography-mass spectrometry has given strong improvement (Cristoni S, Bernardi L R, Gerthoux P, Gonella E, Mocarelli P. *Rapid Commun. Mass Spectrom.* 2004; 18: 1847; Marquet P, Lachatre G. *J. Chromatogr. B Biomed. Sci. Appl.* 1999; 73: 93; Sato M, Hida M, Nagase H. *Forensic Sci. Int.* 2002; 128: 146). In particular this technique has permitted to directly analyze addict drug compounds in urine samples without subjecting them to the derivatization reaction (Cristoni S, Bernardi L R, Gerthoux P, Gonella E, Mocarelli P. *Rapid Commun. Mass Spectrom.* 2004; 18: 1847). This reaction is, in fact, necessary to analyze these compounds when the gas-chromatography mass spectrometry technique (GC-MS) is employed, increasing the costs of the analysis. Another field of interest is the analysis of macromolecules like proteins, peptides and oligonucleotides (Kim S Y, Chudapongse N, Lee S M, Levin M C, Oh J T, Park H J, Ho I K. *Brain Res. Mol. Brain Res.* 2005; 133: 58; Cristoni S, Bernardi L R. *Mass Spectrom. Rev.* 2003; 22: 369; Cristoni S, Bernardi L R, Biunno I, Tubaro M, Guidugli F. *Rapid Commun. Mass Spectrom.* 2003; 17: 1973; Willems A V, Deforce D L, Lambert W E, Van Peteghem C H, Van Bocxlaer J F. *J. Chromatogr. A.* 2004; 1052: 93.). Once these molecules have passed through an ionization source, the charged molecules are analyzed using a mass spectrometric analyzer (Ion Trap (IT), Time Of Flight (TOF), Fourier Transform Ion Cyclotron Resonance (FTICR), Quadrupole, Triple Quadrupole ($Q_1Q_2Q_3$) etc).

The ionization source is a key component of the mass spectrometer. It transforms neutral molecules into ions which can be analyzed by mass spectrometry. It must be stressed that various ionization sources are employed to ionize the analytes because of the fact that various physicohemical ionizing effect must be used depending on the physicochemical behavior of the compound to be ionized. Actually, the most used ionization sources are Electrospray (ESI), Atmosheric Pressure Chemical Ionization (APCI) and Matrix Assisted Laser Desorption Ionization (MALDI) techniques that are highly effective for the production of ions in the gas phase, to be subsequently analyzed by Mass Spectrometry (MS) (Cristoni S, Bernardi L R. Mass Spectrom. Rev. 2003; 22: 369). While ESI and APCI operate on liquid samples, MALDI is used to analyze solid state samples.

In the case of ESI a strong electric field is used to both vaporize and ionize the analyte. In this case multi-charge ions (one molecule gives rise to more than one signal) of medium/high molecular weight compounds (like proteins and oligonucleotides) are produced. The mass spectra so obtained are difficult to analyze and specific software algorithms can be used for data analysis (Pearcy J O, Lee T D. *J. Am. Soc. Mass Spectrom.* 2001; 12: 599; Wehofsky M, Hoffmann R. J Mass Spectrom. 2002; 37: 223). Low molecular weight compounds give usually rise to a mass spectrum simple to analyze due to the formation of mono-charged ions (one molecule gives rise only to one signal). Thus, this ionization source is mainly used to analyze medium- and high-polar compounds having low-, medium- or high-molecular weight.

In the case of APCI the sample is first gasified at high temperature (250-500° C.) and then ionized through the corona discharge effect produced by a needle placed at high potential (2000-8000 V). This ionization approach can be used to analyze low molecular weight compounds (molecular weight<600 Da) having medium low polarity (e.g. steroids etc).

In the case of MALDI low charge state molecules are produced (typically mono- and bi-charged ions). In this case the analyte is co-crystallized with a matrix compound able to adsorb ultraviolet (UV) light with a wavelength of 337 nm. The co-crystallized sample is then placed in a vacuum region ($10^{-8}$ torr) and irradiated with a 337 nm UV laser light. A micro-explosion phenomenon, named "ablation" takes place at the crystal surface so that analyte and matrix are gasified. Moreover, the analyte is ionized by various reactions that typically takes place between analyte and matrix. This approach is usually employed to analyze high molecular weight compounds having various polarities.

All the above described ionization approaches are not suitable to analyze non-polar compounds like benzene, toluene etc. For this reason a new ionization source named Atmospheric Pressure Photo Ionization has been developed and employed to analyze various compounds (Raffaelli A, Saba A. Mass Spectrom Rev. 2003; 22; 318). As in the case of APCI the liquid sample solution is gasified at high temperature. The analyte is then irradiated by a UV light (10 ev Kr light) and ionized through various physicochemical reactions (mainly charge and proton exchange and photoionization reactions).

A new ionization approach, named "Surface Activated Chemical Ionization—SACI" has been also recently developed in order to improve the performance of the commercially available mass spectrometer in the analysis of various kind of compounds extracted from biological matrix (PCT No WO 2004/034011). This apparatus is based on the introduction of a surface for the ionization of neutral molecules in an atmospheric pressure chamber. SACI has been obtained by upgrading the Atmospheric Pressure Chemical Ionization (APCI) source (Cristoni S, Bernardi L R, Biunno I, Tubaro M, Guidugli F. *Rapid Commun. Mass Spectrom.* 2003; 17: 1973). In fact, it was observed that introducing into the APCI ionization chamber an element carrying a plate-like active-surface can bring to unexpected results in terms of high sensitivity and possibility to detect molecules having a molecular weight in a broad range of values (Cristoni S, Bernardi L R, Biunno I, Tubaro M, Guidugli F. *Rapid Commun. Mass Spectrom.* 2003; 17: 1973; Cristoni S, Bernardi L R, Gerthoux P, Gonella E, Mocarelli P. *Rapid Commun. Mass Spectrom.* 2004; 18: 1847; Cristoni S, Sciannamblo M, Bernardi L R, Biunno I, Gerthoux P, Russo G, Chiumello G, Mora S. *Rapid Commun. Mass Spectrom.* 2004; 18: 1392).

However, there is no ionization source able to softly ionize all compounds. This is mainly due to their different physicochemical proprieties, thus, different physicochemical effects must be employed in order to give rise to the analyte ionization.

PURPOSE AND DESCRIPTION OF THE INVENTION AND IMPROVEMENTS OVER THE PRIOR ART

This invention relates to a method and apparatus (FIG. 1) named Universal Soft Ionization Source (USIS) able to ionize all classes of compounds and to increase the instrumental sensitivity with respect to the usually employed Atmospheric Pressure Ionization (API) techniques. The core of the invention is based on a surface on which various physicochemical stimuli are combined in order to amplify the ionization effect. This approach is very different with respect to the SACI one (PCT No WO 2004/034011). SACI, in fact, uses an ionizing surface inserted into an Atmospheric Pressure Ionization (API) chamber and ionize the samples simply by applying a low potential (200 V) on it. The main difference with respect to the present USIS technique is that only medium- to high-polar compounds can be ionized using SACI. Thus, the classes of compounds that can be ionized are the same of ESI even if a higher sensitivity is achieved. It must be pointed out that the USIS technique leads to a strongly enhancement of the sensitivity with respect to the ESI and APCI techniques. The application of various physicochemical stimuli (UV light, tunnel effect, electrostatic potential, ultrasound and microwave) on the surface makes possible to strongly ionize the analyte of interest and to reduce the ionization of solvent molecules that can lead to increase the chemical noise thus reducing the S/N ratio. It has been observed that the analyte is usually soft ionized (the analyte ions do not fragment in the ionization source but reach intact the detector) through charge transfer or proton-transfer reaction.

Another innovative aspect of the present invention is the possibility to be used within a wide range of experimental conditions. Usually the ESI and APCI ionization sources operate using different flows of the analyte solution into the ionization chamber. In particular, ESI typically operates at ionization flow lower than 0.3 mL/min while APCI works in the range 0.5-2 mL/min. The USIS ionization source can work in the full flow range (0.010-2 mL/min) thanks to the particular combination of physicochemical ionization effects. It is so possible to analyze any compound with high instrumental sensitivity and strongly increasing the versatility of the mass spectrometry instruments operating in liquid phase.

Scheme showing an embodiment of the USIS ionization source according to the invention. The various part of the apparatus are: (1) Mass spectrometer analyzer entrance, (2) USIS flange, (3) Empty chamber, (4) Surface, (5) Connector, (6) Assembly apparatus, (7) Power connector, (8) Screw, (9) Screw, (10) Sample inlet hole, (11) Inlet assembly, (12) Nebulizer Region, (13) Electricaly charged region, (14) Nebulizer gas line, (15) Nebulizer gas line, (16) Power connector, (17) Screws, (18) Screws, (19) Assebly, (20) Power connector, (21) UV-VIS or IR LASER or lamp, (22) UV-VIS or IR laser or lamp, (23) Power Connector for ultrasound application, (24) Power connector for lamp or laser, (25) Vacum or under pressure tube, (26) Power supply, (27) Power supply, (28) Power supply, (29) Power supply, (30) Power connector, (31) Power supply.

Figure 2:
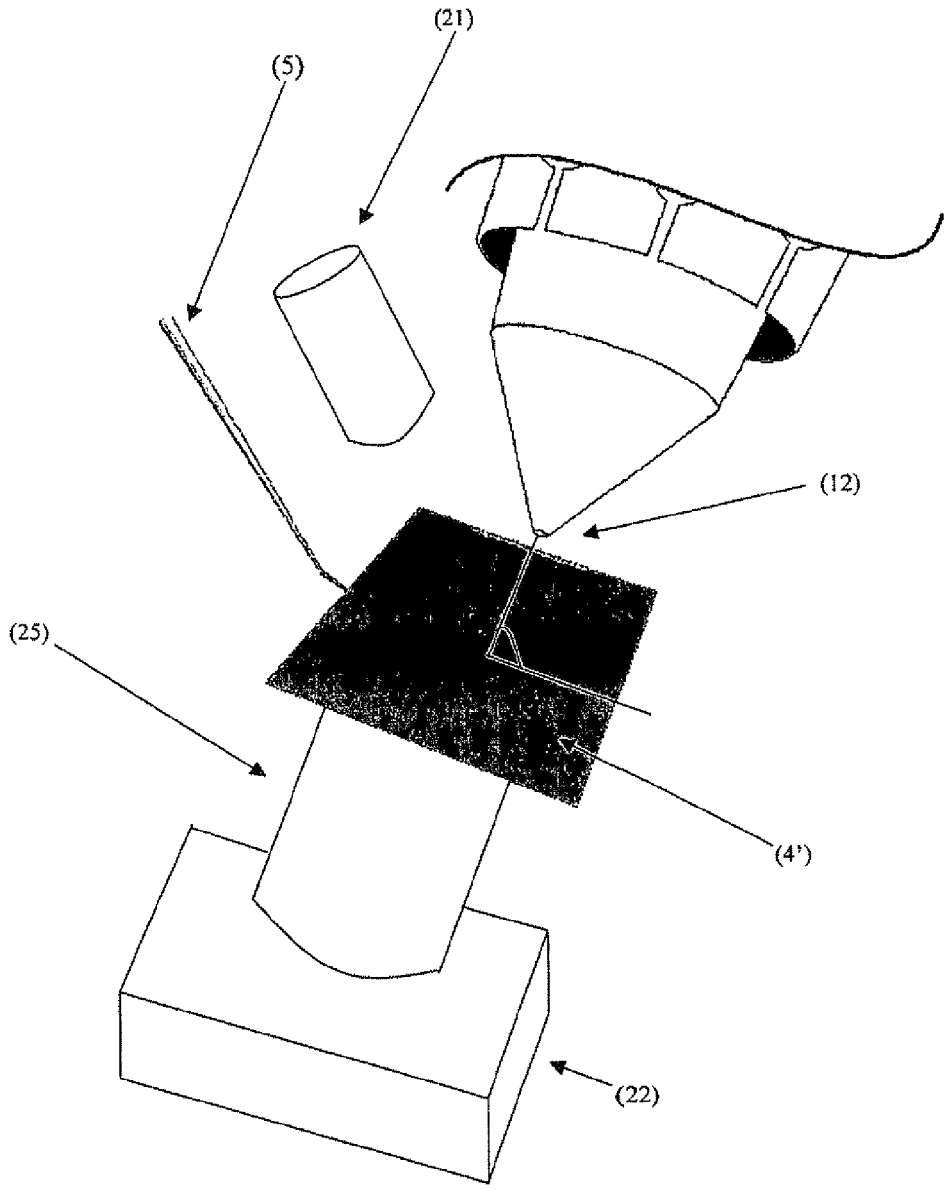

FIG. 2: (Tunnel Effect)

Zoom view of the ionizing surface employed in the USIS ionization approach.

FIG. 3

Proton transfer ionization reactions that can take place using USIS. In this case a molecule is solvated by solvent molecules (cluster). The surface (4') is excited with various effects (ultrasounds, UV light, electrostatic potential) so as to concentrate the energy of these physical effects on the surface. When the cluster containing the solvent collide with the excited surface (4') the solvent is detached from the analyte producing positive or negative ions due to proton exchange or other kind of reactions. The various effects applied to the surface provide the activation energy to strongly enhance the ionization activity. The ionization steps are: A) The clusters are sprayed on the surface with a nebulizer gas flow (2.5 L/min or higher), B) The cluster collides against the surface and C) Analyte ionization takes place on it, after detachment of the solvent by interaction with the excited surface.

FIG. 4

USIS ionization source.

FIG. 5

Full scan mass spectra obtained analyzing a 50 ng/mL MDE solution obtained using a) APCI, b) ESI, and c) USIS ionization sources respectively. The samples were solubilized using water. The direct infusion sample flow was 20 μL/min. The surface potential, electrospray needle voltage (13) and surface temperature were 50 V, 0 V and 110° C. respectively. The UV lamp and ultrasound were turned off. The nebulizer gas flow was 2 L/min.

FIG. 6

MS/MS mass chromatogram obtained analyzing MDE contained in an urine sample using a) APCI, b) ESI and c) USIS ionization sources respectively. The urine samples were diluted 20 times before the analysis. The gradient was performed using two phases: A) Water+0.05% Formic Acid and B) $CH_3CN$+0.05% Formic Acid. In particular 15% of phase B was maintained for 2 minutes then a liner gradient of 8 minutes from 15% to 70% was performed and in 2 minutes the initial conditions were reached. The acquisition time was 24 minutes in order to re-equilibrate the chromatographic column. A Thermoelectron C8 150×1 mm column was used. The Eluent flow rate was 100 μL/min. The surface potential, electrospray needle voltage (13) and surface temperature were 50 V, 0V and 110° C. respectively. The UV lamp and ultrasounds were turned off. The nebulizer gas flow was 2 L/min.

FIG. 7

Full scan mass spectra obtained analyzing a 100 ng/mL standard arginine solution obtained using a) APCI, b) ESI, and c) USIS ionization sources respectively. The samples were solubilized using waters. The direct infusion sample flow was 20 μL/min. The surface potential, electrospray needle voltage (13) and surface temperature were 50 V, 0 V and 110° C. respectively. The UV lamp was turned off while ultrasounds were turned on. The nebulizer gas flow was 2 L/min.

FIG. 8

MS3 mass chromatogram obtained analyzing arginine extracted from a human plasma sample using a) APCI, b) ESI, and d) USIS ionization sources respectively. The gradient was performed using two phases: A) $CH_3OH/CH_3CN$ 1:1+0.1% Formic Acid+Ammonium formiate (20 μmol/L) and B) $H_2O$+0.1% Formic Acid+Ammonium formiate (20 μmol/L). The arginine was extracted from plasma using the protein precipitation approach based on the use of phase A as protein precipitating agent. The analysis was performed in isocratic conditions using 4% of B. The acquisition time was 6 minutes in order to re-equilibrate the chromatographic column. A waters SAX 100×4.1 mm column was used. The Eluent flow rate was 1000 μL/min. The surface potential, electrospray needle voltage (13) and surface temperature were 50 V, 0 V and 110° C. respectively. The UV lamp was turned off while ultrasounds were turned on. The nebulizer gas flow was 2 L/min.

FIG. 9

Full Scan MS direct infusion analysis of a 3 μg/mL standard solution of the P2 peptide (PHGGGWGQPHGGGWGQ MW: 1570) obtained using a) APCI, b) ESI and c) USIS ionization sources respectively. The sample was solubilized using water. The direct infusion sample flow was 20 μL/min. The surface potential, electrospray needle voltage (13) and surface temperature were 50 V, 350 V and 50° C. respectively. The UV lamp was turned off while ultrasounds were turned on. The nebulizer gas flow was 2 L/min.

FIG. 10

Mass Spectra obtained analyzing a $10^{-7}$ M solution of an oligonucleotide with a molecular weight of 6138 Da. 1% of tryethylamine was present in the solution. The following atmospheric pressure ionization sources were used: a) APCI, b) ESI and c) USIS. As it can be seen, while in the cases a), b) and c) no oligonucleotide ion signal was detected, in the case d) the signals were clearly detected. The counts/s value was $10^7$ with a S/N ratio of the most abundant peak of 150. The surface potential, electrospray needle voltage (13) and surface temperature were 50 V, 350 V and 50° C. respectively. The UV lamp was turned off while ultrasounds were turned on. The deconvolution spectrum showing the molecular mass of the analyzed oligonucleotide, obtained using USIS, is also shown (see spectrum c).

FIG. 11

Mass Spectra obtained analyzing a $10^{-7}$ M solution of an oligonucleotide with a molecular weight of 6138 Da. 1% of tryethylamine and NaCl salt with a concentration of $5*10^{-6}$ M were present in the solution. The following atmospheric pressure ionization sources were used: a) APCI, b) ESI, and c) USIS ionization sources. As it can be seen also in this case only using USIS ionization approach the oligonucleotide multi-charged signals were detected. The counts/s value was 106 with a S/N ratio of the most abundant peak of 30. The surface potential, electrospray needle voltage (13) and surface temperature were 50 V, 350 V and 50° C. respectively. The UV lamp was turned off while ultrasound were turned on. The deconvolution spectrum showing the molecular mass of the analyzed oligonucleotide, obtained using USIS, is also shown (see spectrum c).

FIG. 12

Full scan mass spectra obtained analyzing a 50 ng/mL standard estradiol solution obtained using a) APCI, b) ESI and b) USIS ionization sources respectively. The sample was solubilized using $CH_3OH$. The direct infusion sample flow was 20 μL/min. The surface potential, electrospray needle voltage (13) and surface temperature were 50 V, 0 V and 110° C. respectively. The UV lamp was turned on while ultrasounds were turned off. The nebulizer gas flow was 2 L/min.

FIG. 13

Full scan mass spectra obtained analyzing a 50 ng/mL standard estradiol solution obtained using a) APCI a) ESI and b) USIS ionization sources respectively. The sample was solubilized using $CH_3CN$. The direct infusion sample flow was 20 μL/min. The surface potential, electrospray needle voltage (13) and surface temperature were 50 V, 0 V and 110° C. respectively. The UV lamp was turned on while ultrasounds were turned off. The nebulizer gas flow was 2 L/min.

DESCRIPTION OF A PREFERRED EMBODIMENT OF THE PRESENT INVENTION AND APPLICATION EXAMPLES

Figure 1:
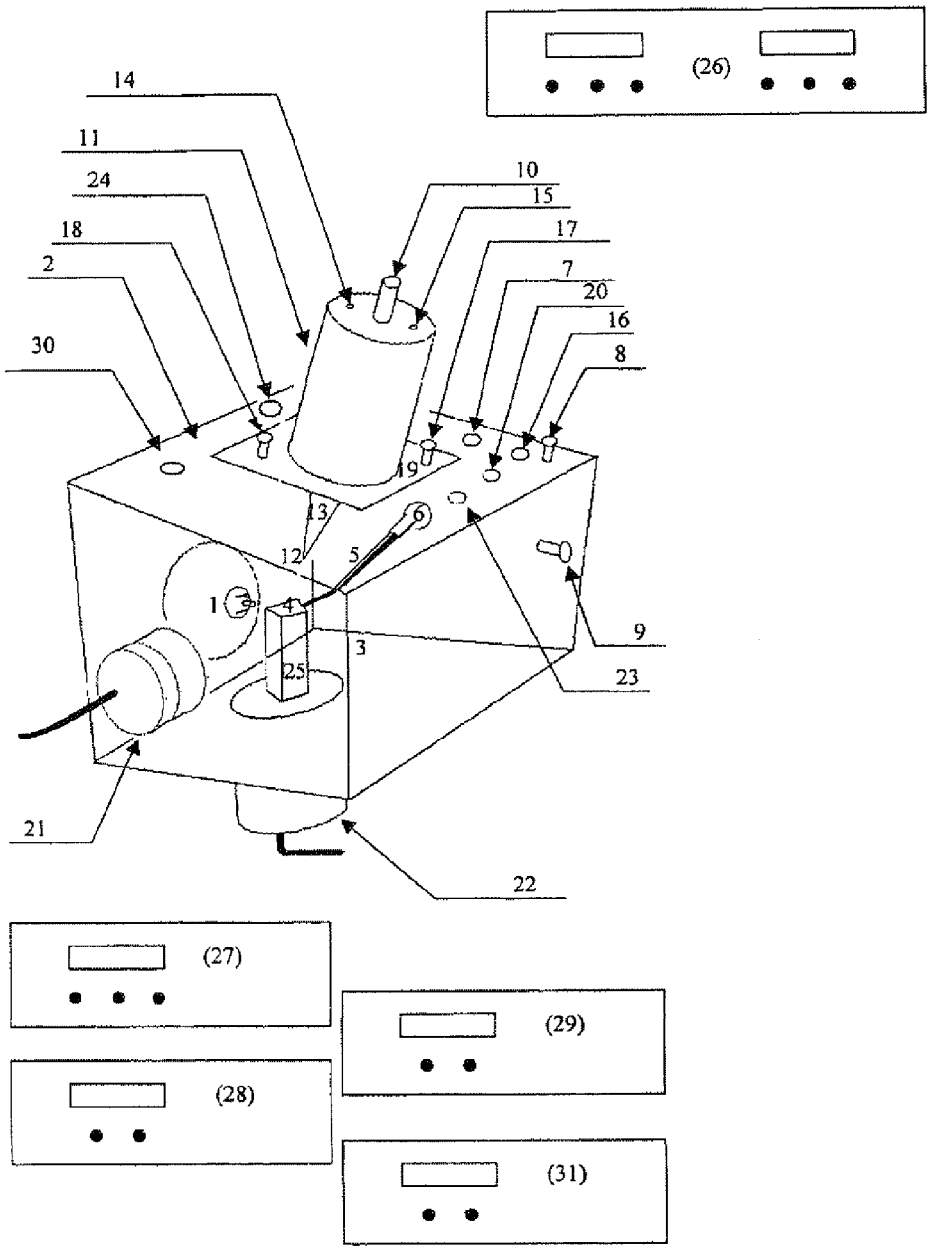
FIG. 1

The scheme of the USIS ionization source is shown in FIG. 1. The USIS ionization source produces ions that are analyzed with a mass spectrometer using a wide range of experimental conditions (e.g. polar and not polar solvent, various flow rates etc).

The spectrometer comprises an ionization source, an analyzer or filter for separating the ions by their mass-to-charge ratio, a detector for counting the ions and a data processing system. Since the structure of the spectrometer is conventional, it will not be described in more detail. The ionization source device of the invention comprises an inlet assembly (11) which is in fluid communication with an ionization chamber (3).

Figure 3:
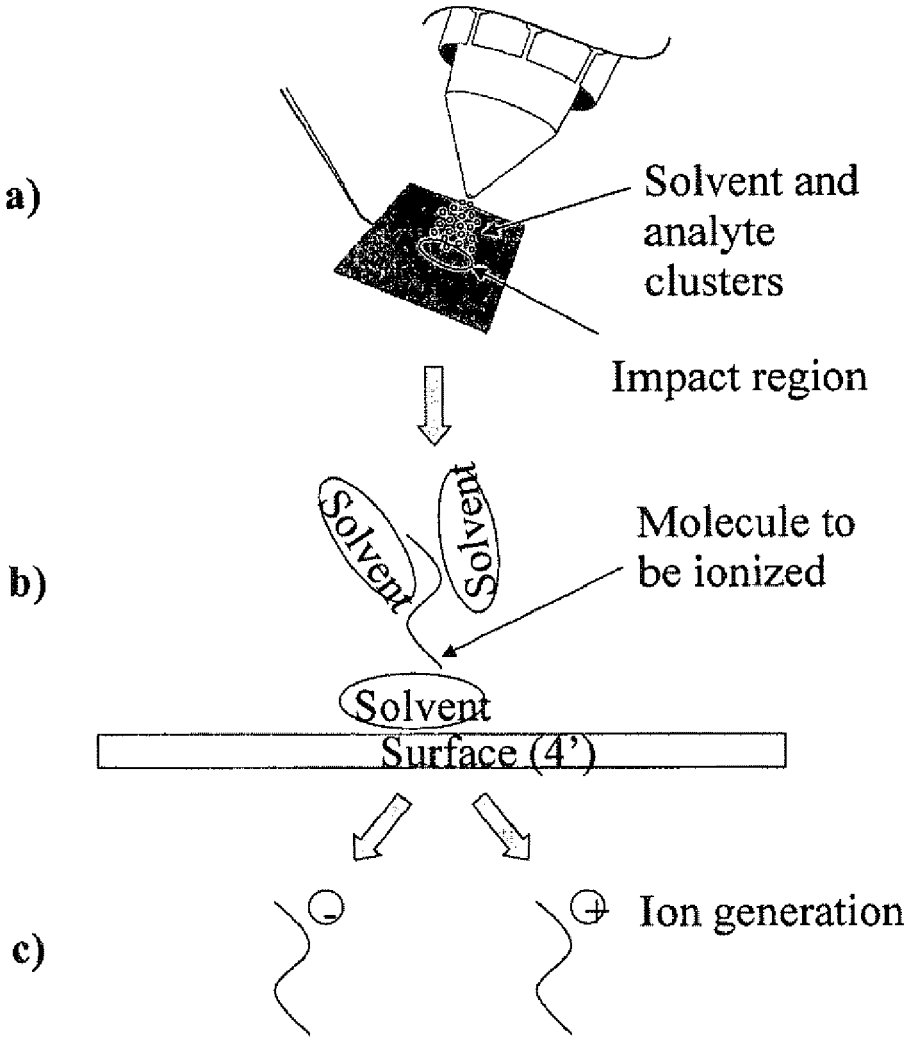

The ionization chamber (3) comprises an outlet orifice (1), generally less than 1 mm in diameter, for communicating between the ionization chamber and the analyzer or filter. Generally, the angle between the axis of the inlet assembly (11) and the axis passing through said orifice is about 90°, but different relative positions can also be envisaged. Inside the ionization chamber (3) is positioned a plate (4). The plate (4) has at least one active surface (4') which faces the internal aperture of the inlet assembly (11). Preferably, the plate (4) is orthogonal or placed at 45° with respect to the axis of the nebulizer (12) (FIGS. 2 and 3). Different physical ionization effects (e.g. UV radiation, ultrasound and electrostatic potential) can be focalized on the surface to strongly increase the ionization efficiency. Moreover also the selectivity of the approach increases. In fact the combination of different physical ionization effects on the surface allows to selectively ionize the analyte of interest.

The plate (4) can have different geometries and shapes (see for instance FIGS. 2 and 3), such as squared, rectangular, hexagonal shape and so on, without departing for this from the scope of the present invention. It has been found that the sensitivity of the analysis increases when the active surface (4') is increased. For this reason, the plate (4) surface will range preferably between 1 and 4 cm2 and will be generally dictated, as the highest threshold, by the actual dimensions of the ionization chamber (3). While maintaining the dimension of the plate (4) fixed, the active surface (4') area can be increased in various ways, for example by creating corrugations on the surface (4'). In particular cases, for example when high molecular weight molecules must be analyzed, high electrical field amplitude is required. In such cases, it may be advantageous to provide the active surface (4') with a plurality of point-shaped corrugations, in order to increase therein the electrical field amplitude. It has been observed also that the sensitivity strongly increases when a strong turbulence is generated by positioning the surface (4') orthogonal with respect to the axis of the nebulizer (12) and applying a strong gas flow (typically nitrogen at a flow of 10 L/min or higher) through the nebulization region (12). Various geometries and angles with respect to the inlet assembly (11) can be used in order to increase the turbulence effect. The preferred configuration is the surface (4') placed orthogonal or at 45° with respect to the axis of the nebulizer region (12) and the surface is near to the inlet hole (1) of the mass spectrometer so as to produce multi collision phenomena of the solvent analyte clusters that lead to the ionization of the analyte and to direct the gas flow and the analyte ions to the inlet hole (1). The flow of the analyte solution through the inlet system (11) can be between 0.0001-10000 μL/min with a preferred flow of 100 μL/min.

The active surface (4') can be made of various materials, either of electrically conductive or non-conductive nature. Preferred materials can be a metal such as iron, steel, copper, gold or platinum, a silica or silicate material such as glass or quartz, a polymeric material such as PTFE (Teflon), and so on. When the active surface (4') is composed of a non-conductive material, the body of the plate (4) will be made of an electrically conductive material such as a metal, while at least a face thereof will be coated with a non-conductive material in form of a layer or film to create the active surface (4'). For example, a stainless steel plate (4) can be coated with a film of PTFE. It is in fact important that, even if made of non-conductive nature, the active surface (4') be subjected to a charge polarization. This will be achieved by applying an electric potential difference, through the power supply (26), to the body plate, thus causing a polarization by induction on the active surface (4') too. On the other hand, if the surface (4') is of electrical conductive nature, the plate (4) does not need to be coated. In this case, a good performance of the ionization source of the invention can be achieved even without applying a potential difference, i.e. by maintaining the surface (4') at ground potential and allowing it to float. However, this is obtained also if a potential charge polarization is applied to the electrically conductive surface (4').

The plate (4) is linked, through connecting means (5), to a handling means (6) that allows the movement of the plate (4) in all directions. The handling means (6) can be moved into the ionization chamber and can also be rotated. The connecting means (5) can be made of different electrically conductive materials and can take various geometries, shapes and dimensions. Preferably, it will be shaped and sized so as to facilitate the orientation of the plate (4) in an inclined position. The plate (4) is electrically connected to a power supply means (26) in order to apply a potential difference to the active surface (4'). The plate (4) has generally a thickness of between 0.05 and 100 mm, preferably of between 0.1 and 3 mm.

Various physical stimuli can be applied to the surface (4'). The laser (21) can irradiate the surface (4') in order to improve the ionization of the analyte that collide with the surface (4') or that is deposited on it. The laser can work in the UltraViolet-Visible (UV-VIS) or Infrared (IR) light spectrum region using various wavelengths (typically between 0,200 and 10.6 μm) the preferred wavelengths are 337 nm for UV-VIS and 10.6 μm for IR. The lamps, UV-laser are connected to an external commercially available power supply (27). A molecule that adsorbs the UV-VIS or IR wavelength is added to the sample solution to further improve the ionization efficiency. For example, synapinic acid or caffeic acid can be used for this purpose. These molecules are in fact excited through laser irradiation. These excited species react with the sample molecules and give rise to the formation of analyte ions. The UV-VIS or IR lamp (22) can be also employed to irradiate the surface (4) and the liquid sample that reach the surface (4) through the inlet apparatus (11). The surface (4) or (4') can give rise to the formation of electrons or other ions, when it interacts with the photons, that can ionize the analyte molecules. The laser and lamp light can be positioned both inside and outside the ionization chamber and can irradiate both the solvent and the surface (4) or (4') or only the surface through a close tube (25) (see zoom view in FIG. 2) that avoid the direct interaction of the solvent and analyte with the light. The tube can be under vacuum when connected with pumps or at atmospheric pressure when the vacuum pumps are off. When the apparatus operates under vacuum it is possible to use the tunnel effect in order to ionize the analyte so as to reduce the chemical noise. In this case the surface must be thin (0.05-0.1 mm preferably 0.05 mm) in order to permit to the electrons generated inside the tube to pass through the surface and interact with the analyte leading to its ionization. In fact the direct interaction of the laser or UV light with the nebulizer gas and the solvent can lead to the formation of high amount of charged solvent species that leads to a strong chemical noise increase. The tube that connects the laser and lamp light with the thin surface can be maintained at various pressure (vacuum, atmospheric pressure) and can be filled with different gases (e.g. air, nitrogen). Moreover, the temperature of the surface (4) can be changed through the commercially available power supply (31) connected to electric resistances inserted in the surface (4'). The surface is cooled through a commercially available power supply (31) that is also connected to a peltier apparatus that is positioned on the surface (4') and makes it possible to cool the surface. The temperature of the surface (4) can be between −100 and +700° C. and the preferred temperature is between 25-100° C. A power connector (16) or (23) makes it possible to apply ultrasound excitation effect to the ionization chamber (3) through the surface (4) or (4'), subjected to ultrasound ionizing effect through the power supply (26) connected with the connector (16) or with the connector (23) that are connected to the surface (4') through electrically conductive material (copper, steel, gold) and to piezoelectric apparatus connected to the surface (4') that produce ultrasounds having a frequency of 40-200 kHz, preferably between 185-190 KHz, more preferably 186 kHz. Coming now to the description of the inlet assembly (11), the liquid sample containing the analyte is introduced into the chamber through the sample inlet hole (10). The inlet assembly (11) comprises an internal duct, opened outwardly via the said inlet hole (10), which brings to a nebulization region (12). The said nebulization region is in fluid communication with at least one, typically two gas lines (14), (15) (typically, the gas is nitrogen) which intercept the main flow of the sample with different angles, so as to perform the functions of both nebulizing the analyte solution and carrying it towards the ionization chamber (3). A power connector (23) can be used to apply a potential difference between the regions (13) and entrance (1) of the mass spectrometer. This potential can be set between −10000 and 10000 V, preferably between −1000 and 1000 V but 0-500 V are generally employed. This potential can be used for both a) producing analyte ions in the solution and b) vaporizing the solvent and the analyte by electro nebulization effect so as to make it possible to produce gas phase ions of the analyte. The power connector (7) makes it possible to set the temperature of both the nebulizer region (12) and the surface (4') through the commercially available power supply (31) connected to hot electrical resistance or to peltier apparatus inserted in the nebulizer region (12) and in the surface (4'). This temperature can be between −100 and +700° C. The preferred temperature is in the range 100-200° C. and more preferably 200° C. The internal duct of the inlet assembly (11) ends into the ionization chamber (3) in a position which allows the analyte solvent droplets to impact against the active surface (4') of the plate (4) where ionization of the neutral molecules of the analyte takes place. Without being bound to any particular theory, it is likely that a number of chemical reactions take place on the surface: proton transfer reactions, reaction with thermal electrons, reaction with reactive molecules located on the surface, gas phase ion molecule reactions, molecules excitation by electrostatic induction or photochemical effect. For instance, a possible ionization mechanism is shown in FIG. 3. In this case the analyzed molecule is solvated with solvent molecules (cluster). When the cluster collides against the ionizing surface, the solvent is detached from the analyte leading to production of an analyte negative or positive ion. Moreover, it is also possible that the dipolar solvent is attracted by the active surface (4') by means of the charge polarization induced on it thereby allowing the deprotonating or protonating source to form ions. As said above, the plate (4) can be allowed to float and a potential difference can be applied. Such a potential difference, as absolute value, will preferably be in the range of from 0 to 15000 V (in practice, it can range between 0 V and 1000 V, depending on the kind of polarization that is required on the active surface (4'), preferably from 0 to 500 V, more preferably from 0 to 200 V.

The ionization chamber (3) can be also subjected to microwave excitation through the USIS flange (2) so as to apply microwaves to the ionization chamber (3). The microwaves are applied through the external power supply (28) connected to the faraday box through the connector (20). The microwave frequency can be between 915 and 2450 MHz, preferably between 2000 and 2450 MHz, more preferably 2450 MHz. Microwaves are mainly used to vaporize water.

Summarizing, the essential feature of the invention consists in the exposure of a ionizing active surface (4') to different combinations of physical effects (at least two) so to ionize a wide range of organic analyte (polar and non polar). Moreover, this approach allows to increase both the sensitivity and selectivity in the analysis of a target compound.

Figure 4:
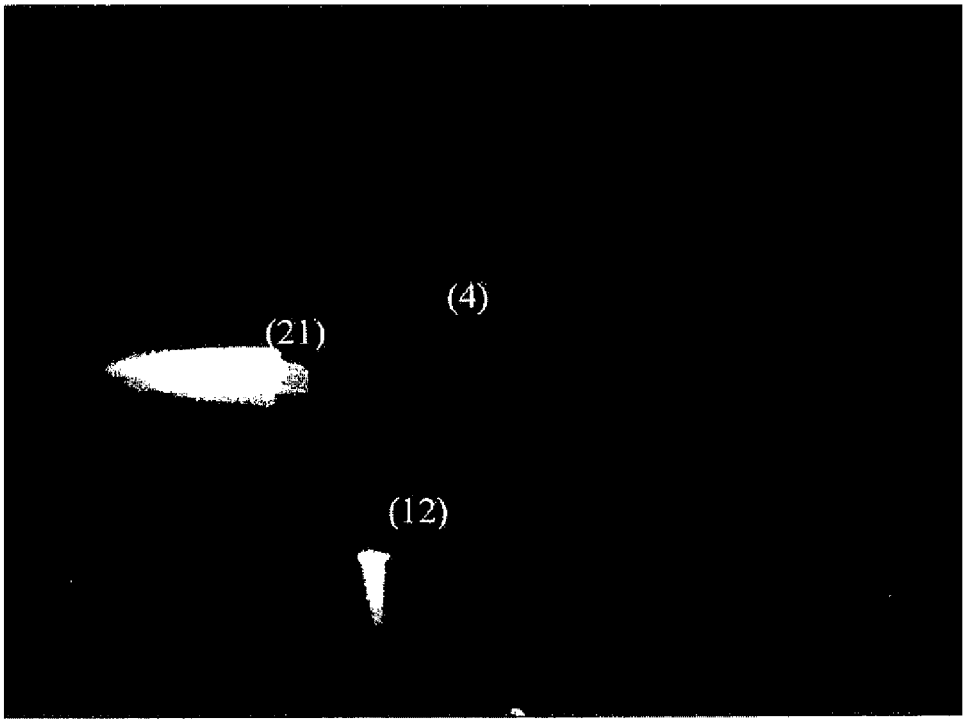

It should be understood that the above description is intended to illustrate the principles of this invention and is not intended to limit any further modifications, which can be made following the disclosure of this patent application by people skilled in the art. FIG. 4 shows a typical internal view of a typical embodiment of the USIS ionization chamber.

The following examples further illustrate the invention.

Example 1

Analysis of MDE Addict Drugs in Diluted Urine Samples

Figure 5:
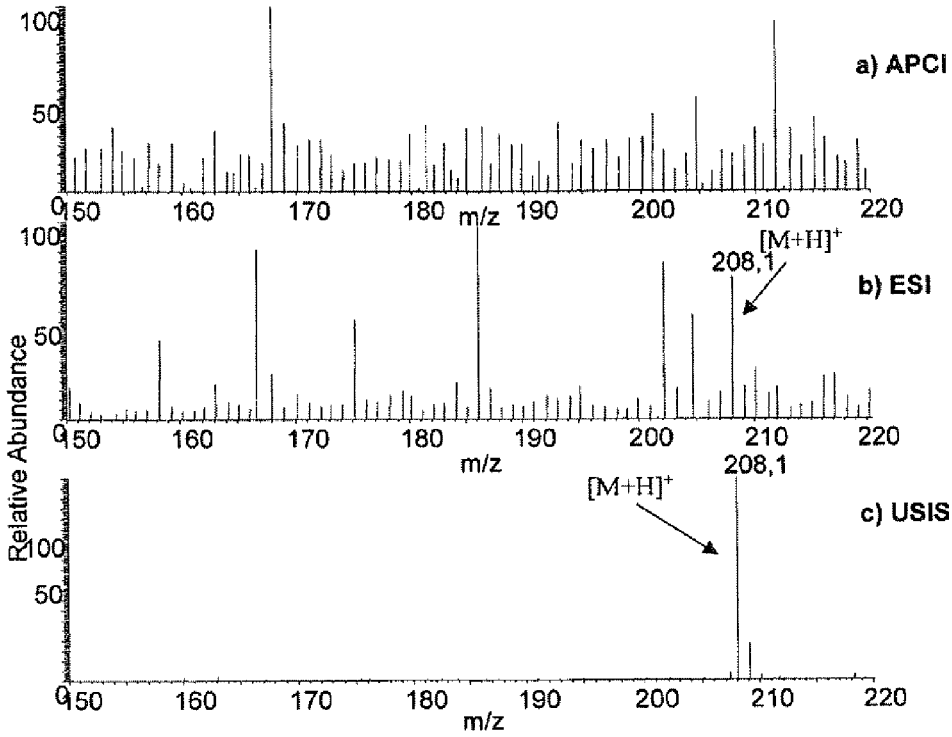

The USIS ionization source was used to analyze the 3,4-methylenedioxyethylamphetamine (MDE) addict drug. An increase in sensitivity with respect to the usually employed techniques (ESI and APCI) was observed. FIGS. 5*a, b*, and *c* show the Full Scan direct infusion spectra obtained analyzing a 50 ng/mL standard solution of MDA obtained using the APCI, ESI and USIS ionization sources respectively. The sample was solubilized using water. The direct infusion sample flow was 20 μL/min. The surface potential, electrospray needle voltage (13) and surface temperature were 50 V, 0 V and 110° C. respectively. The UV lamp and ultrasounds were turned off. The nebulizer gas flow was 2 L/min. As it can be seen, in the case of APCI spectrum no MDE ion signal was detected. In the case of ESI an high chemical noise is present. The $[M+H]^+$ MDE signal at m/z 208 was clearly detected acquiring the Full Scan spectrum using USIS technique. Using USIS a good S/N ratio was achieved (S/N: 100).

Figure 6:
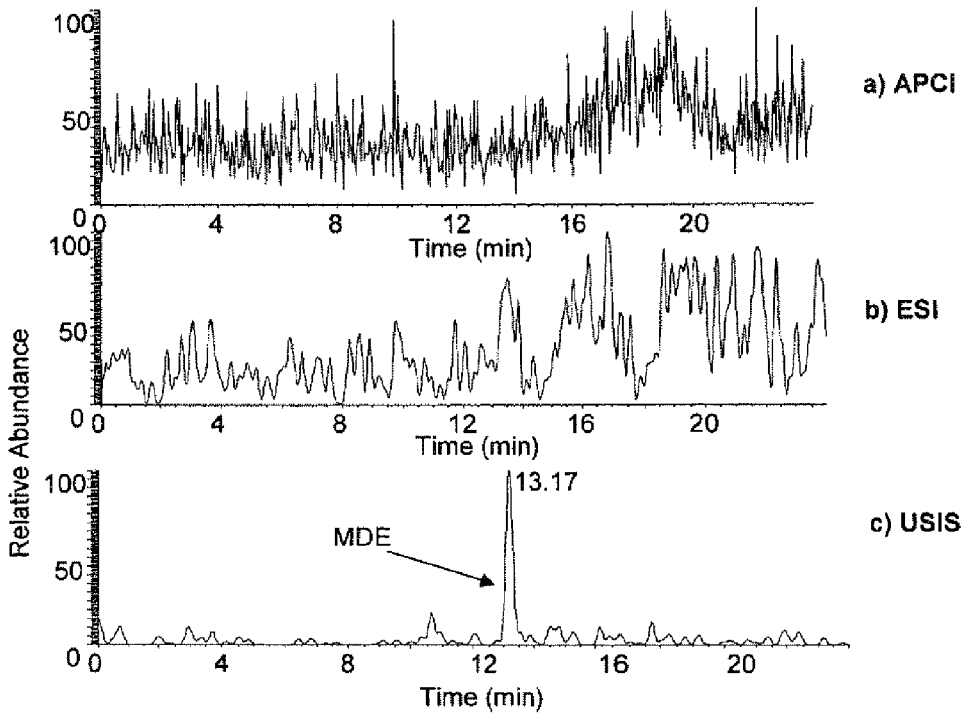

FIGS. 6*a, b* and *c* show the Liquid Chromatography—Tandem Mass Spectrometry analysis (LC-MS/MS) of MDE obtained using a) APCI, b) ESI and c) USIS ionization sources respectively. The urine samples were diluted 20 times before the analysis. The gradient was performed using two phase: A) Water+0.05% Formic Acid and B) $CH_3CN$+0.05% Formic Acid. In particular 15% of phase B was mantained for 2 minutes then a liner gradient of 8 minutes was executed passing from 15% to 70% of B and in 2 minutes the initial conditions were reached. The acquisition time was 24 minutes in order to re-equilibrate the chromatographic column. A ThermolEctron $C_8$ 150×1 mm column was used. The Eluent flow rate was 100 μL/min. The surface potential, electrospray needle voltage (13) and surface temperature were 50 V, 0V and 110° C. respectively. The UV lamp and ultrasound were turned off. The nebulizer gas flow was 2 L/min. As it can be seen, the only technique able to detect MDE was USIS (S/N: 120). The high sensitivity and selectivity obtained using the MS/MS approach makes it possible to clearly identify MDE.

Example 2

Analysis of Arginine Plasma Samples

Figure 7:
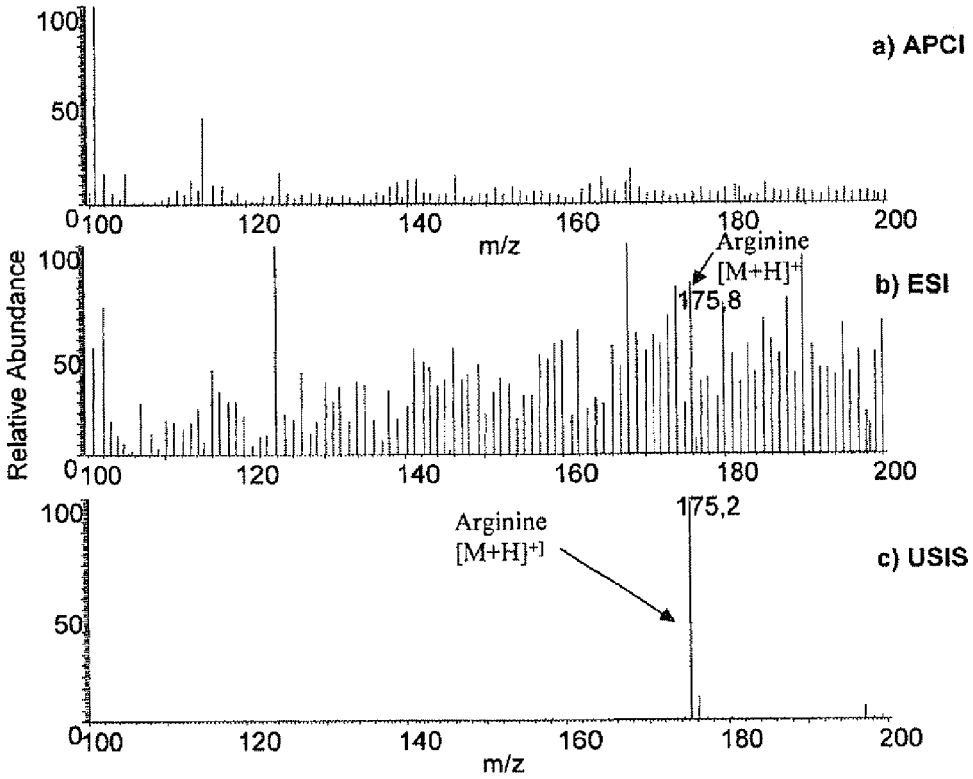

The USIS ionization source was used to analyze the arginine in plasma samples. Also in this case, an increase in sensitivity with respect to the usually employed techniques (ESI and APCI) was observed. FIGS. 7*a, b*, and *c* show the Full Scan direct infusion spectra obtained analyzing a 100 ng/mL arginine standard solution obtained using the a) APCI, b) ESI and c) USIS ionization sources respectively. The sample was solubilized using water. The direct infusion sample flow was 20 μL/min. The surface potential, electrospray needle voltage (13) and surface temperature were 50 V, 0 V and 110° C. respectively. The UV lamp was turned off while ultrasounds were turned on. The nebulizer gas flow was 2 L/min. In the APCI spectrum (FIG. 7*a*) no arginine ion signal was detected. In the case of ESI (FIG. 7*b*) a high chemical noise is present in the spectrum and this fact makes the ion signal of arginine, practically, undetectable acquiring the spectrum in full scan mode. The $[M+H]^+$ MDE signal at m/z 175 was clearly detected acquiring the Full Scan spectrum using USIS technique. In particular, using USIS a good S/N ratio was achieved (S/N: 70).

Figure 8:
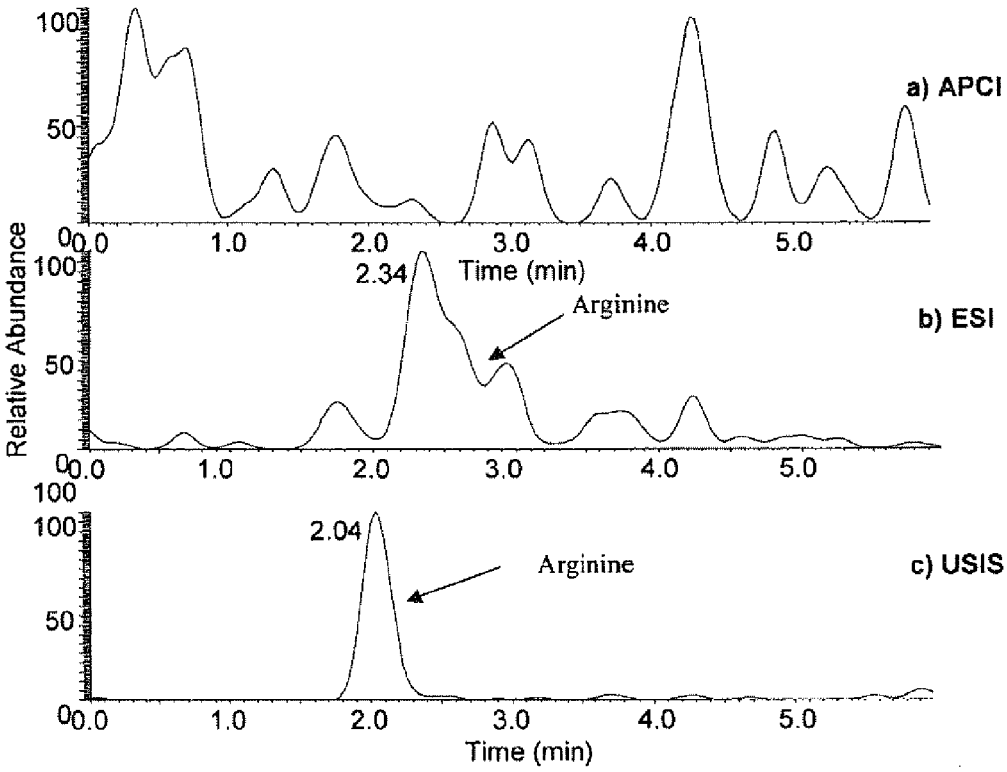

FIGS. 8*a, b*, and *c* show the Liquid Chromatography—Multicollisional analysis (LC-MS3) of ariginine obtained using a) APCI, b) ESI and c) USIS ionization source respectively and fragmenting the $[M+H]^+$ ion at m/z 175 and its product ion at m/z 158. The gradient was performed using two phases: A) $CH_3OH/CH_3CN$+0.1% Formic Acid+Ammonium formiate (20 μmol/L) and B) $H_2O$+0.1% Formic Acid+Ammonium formiate (20 μmol/L). The arginine was extracted from plasma using the protein precipitation approach based on the use of phase A as protein precipitant agent. The analysis was performed in isocratic conditions using 4% of B. The acquisition time was 6 minutes in order to re-equilibrate the chromatographic column. A water SAX 100×4.1 mm column was used. The Eluent flow rate was 1000 μL/min. The surface potential, electrospray needle voltage (13) and surface temperature were 50 V, 0 V and 110° C. respectively. The UV lamp was turned off while ultrasounds were turned on. The nebulizer gas flow was 2 L/min. Also in this case using USIS the highest S/N ratio (S/N: 100) was achieved. Thus, the high sensitivity and selectivity of the $MS^3$ approach makes possible to clearly detect and identify arginine in the chromatograms obtained using USIS (FIG. 8*c*).

Example 3

Analysis of Peptides

Figure 9:
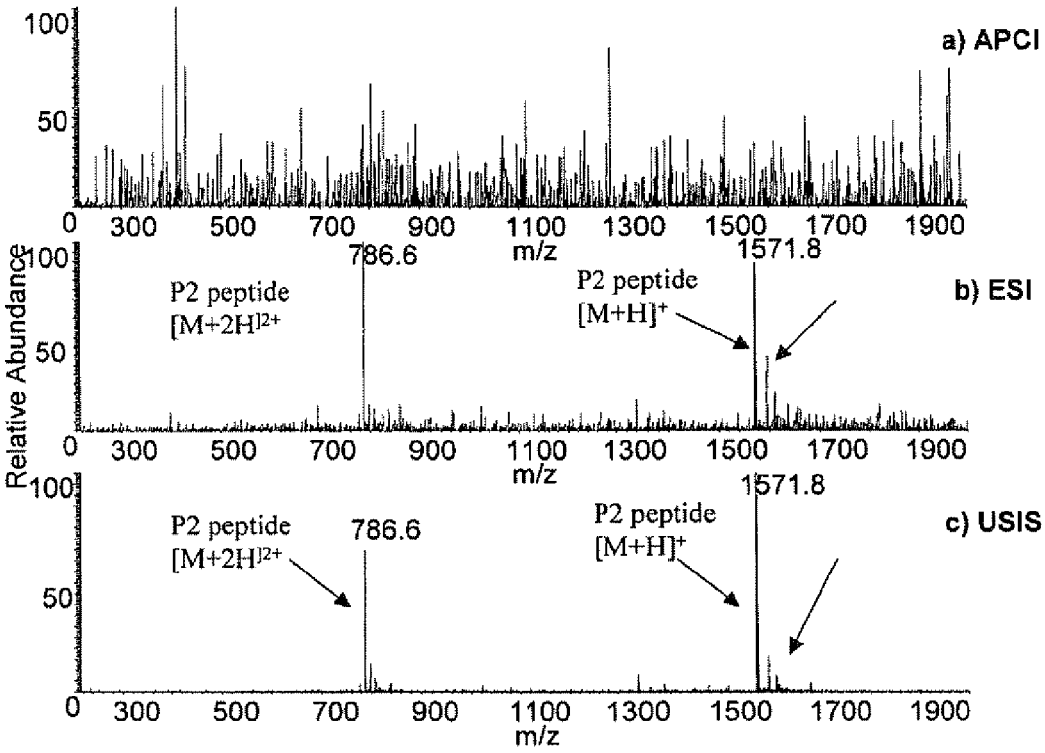

The peptide P2 (PHGGGWGQPHGGGWGQ; partial sequence of the PrPr protein) was analyzed using a) APCI, b) ESI, and c) USIS (FIGS. 9*a, b*, and *c*). The peptide concentration was 3 μg/mL. The sample was solubilized using water. The direct infusion sample flow was 20 μL/min. The surface potential, electrospray needle voltage (13) and surface temperature were 50 V, 350 V and 50° C. respectively. The UV lamp was turned off while ultrasound were turned on. The nebulizer gas flow was 2 L/min. No signal was detected using APCI (FIG. 9*a*). In the case of ESI both the $[M+H]^+$ and $[M+2H]^+$ signals were detected. A S/N ratio of the most abundant peak of 80 and a counts/s value $2\times10^8$ were obtained. The USIS technique gives rise to the best S/N ratio of the most abundant peak (S/N: 180) and to a counts/s value of $1\times10^7$ clearly showing that this ionization technique gives rise to the lower chemical noise.

Example 4

Analysis of Oligonucleotide Aqueous Solution

Figure 10:
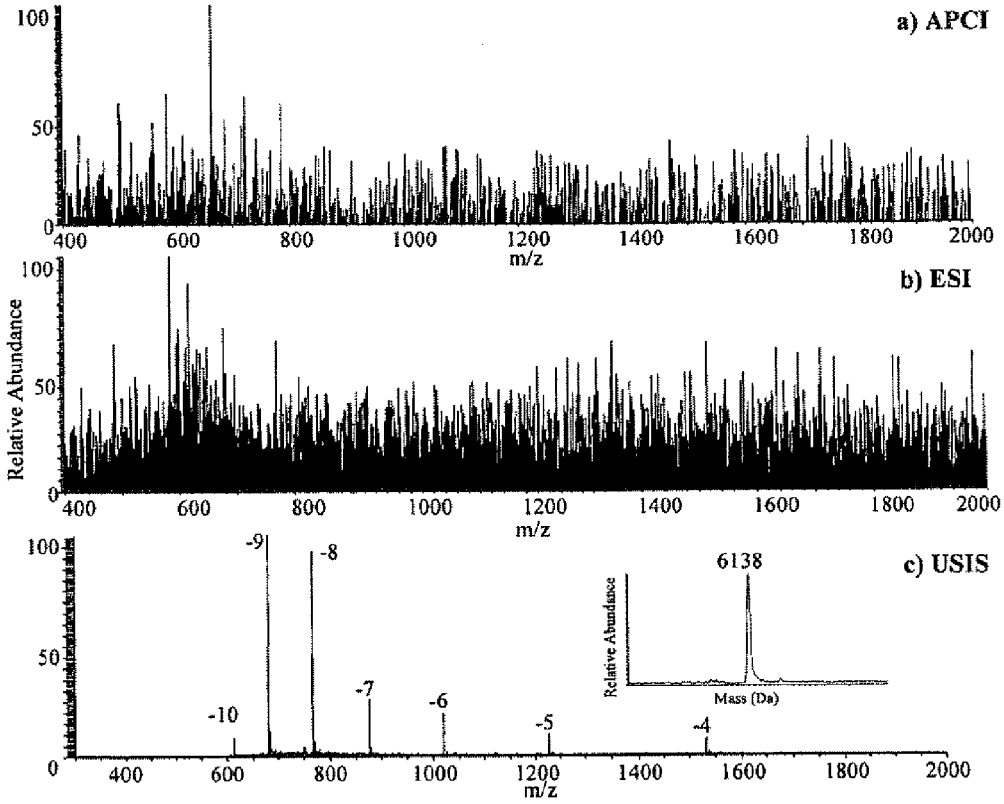

FIGS. 10*a, b* and *c* show the spectra obtained by direct infusion of solutions of an oligonucleotide with a molecular weight of 6138 Da. The spectra were acquired using a) APCI, b) ESI and c) USIS ionization techniques respectively. The solution concentration of the oligonucleotide was $10^{-7}$ M. 1% of triethylamine was added to the sample in order to prevent the signal suppression effect due to the formation of oligonucletides cation adduct. As it can be seen, using the APCI and ESI no oligonucleotide mass ion signal was detected at this concentration level (FIGS. 10*a* and *b*). The situation surprisingly changes when the USIS ionization technique was employed (FIG. 10*c*). In this case, in fact, the oligonucletide negative multi-charged ions are clearly detected. The counts/s value was $10^7$ with a S/N ratio of the most abundant peak of 150. The charge of the oligonucleotide ion distribution ranges from −10 to −4. The UV lamp was turned off while ultrasounds were turned on. It must be emphasized that using the USIS ionization approach, the chemical noise is quite low (noise counts/s=$5*10^5$).

Example 5

Analysis of Oligonucleotide Aqueous Solution Containing Inorganic Salts (e.g. NaCl)

Figure 11:
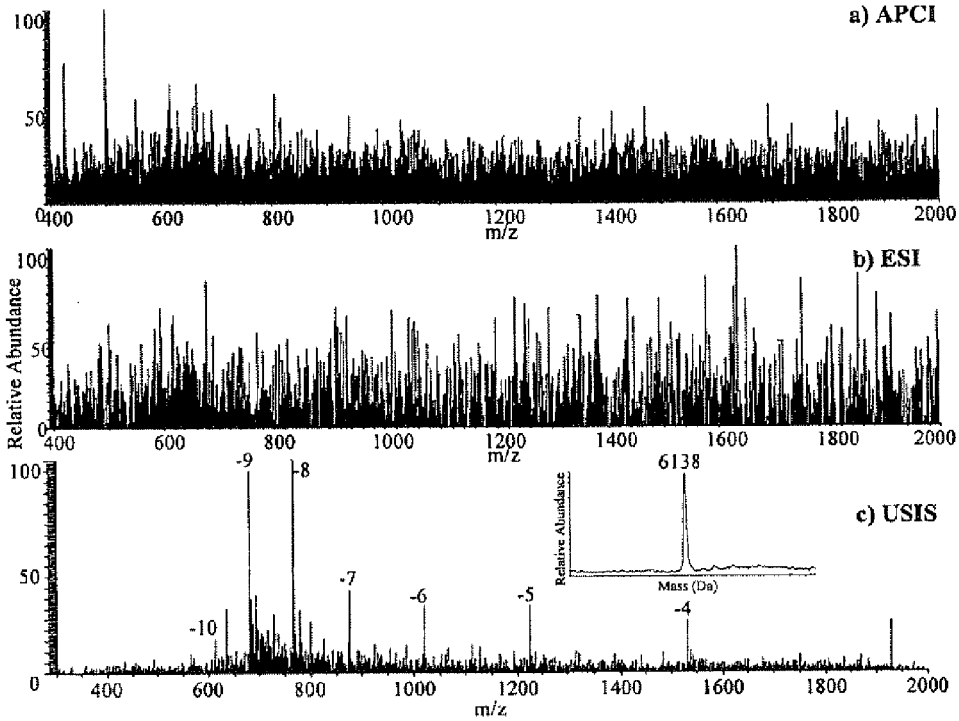

FIGS. 11*a, b*, and *c* show the spectra obtained using a) APCI, b) ESI and c) USIS ionization sources by analyzing an oligonucleotide with a molecular weight of 6138 Da. A concentration of $5*10^{-6}$ M NaCl was added to the sample solution in order to evaluate the performance, in term of sensitivity, in presence of salts. The solution concentration of the oligonucleotide was $10^{-7}$ M. 1% of Tryethylamine was added to the sample solution in order to prevent the signal suppression effect due to the formation of oligonucletides cation adduct. As it can be seen, also in this case, using the APCI and ESI effects no oligonucleotide mass ion signal was detected (FIGS. 11*a* and *b*). In the case of USIS (FIG. 11*d*) the oligonucletide multi-charged ions signals were clearly detected. The counts/s value was $10^6$ with a S/N ratio of the most abundant peak of 30. The charge of the oligonucleotide ion distribution ranges from −10 to −4. It must be emphasized that using the USIS ionization approach, the chemical noise is quite low (noise counts/s=$5*10^4$).

Example 6

Figure 12:
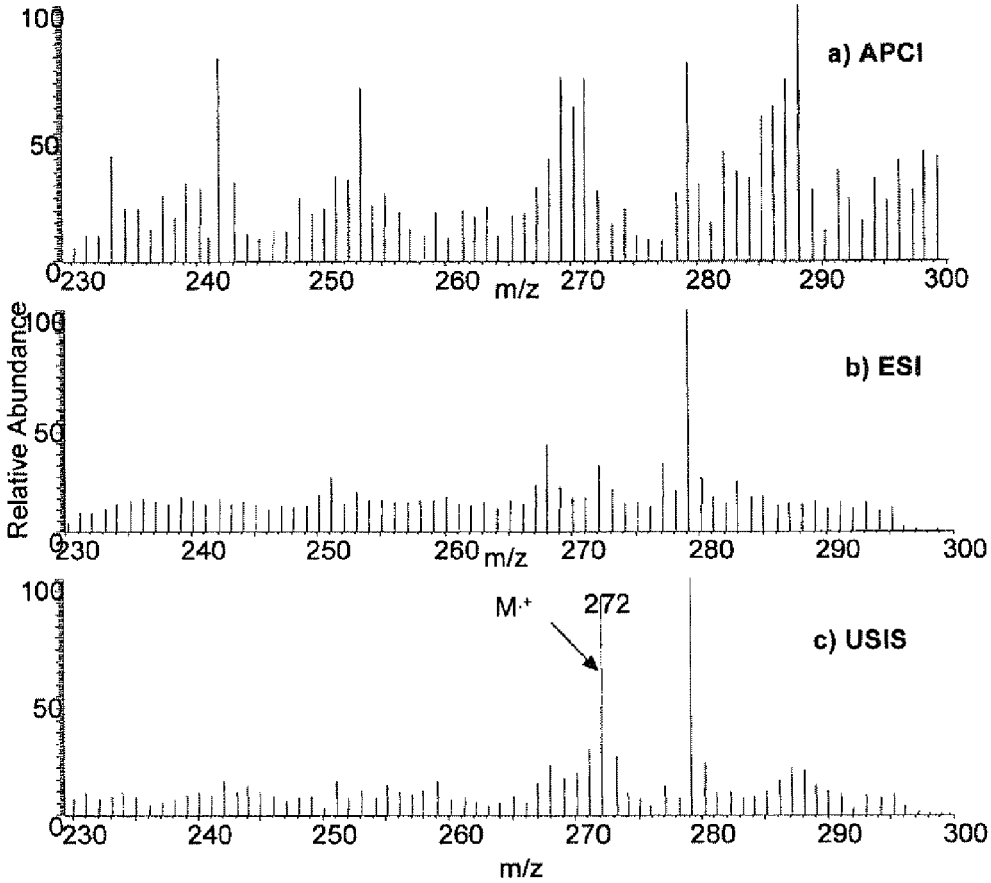
Figure 13:
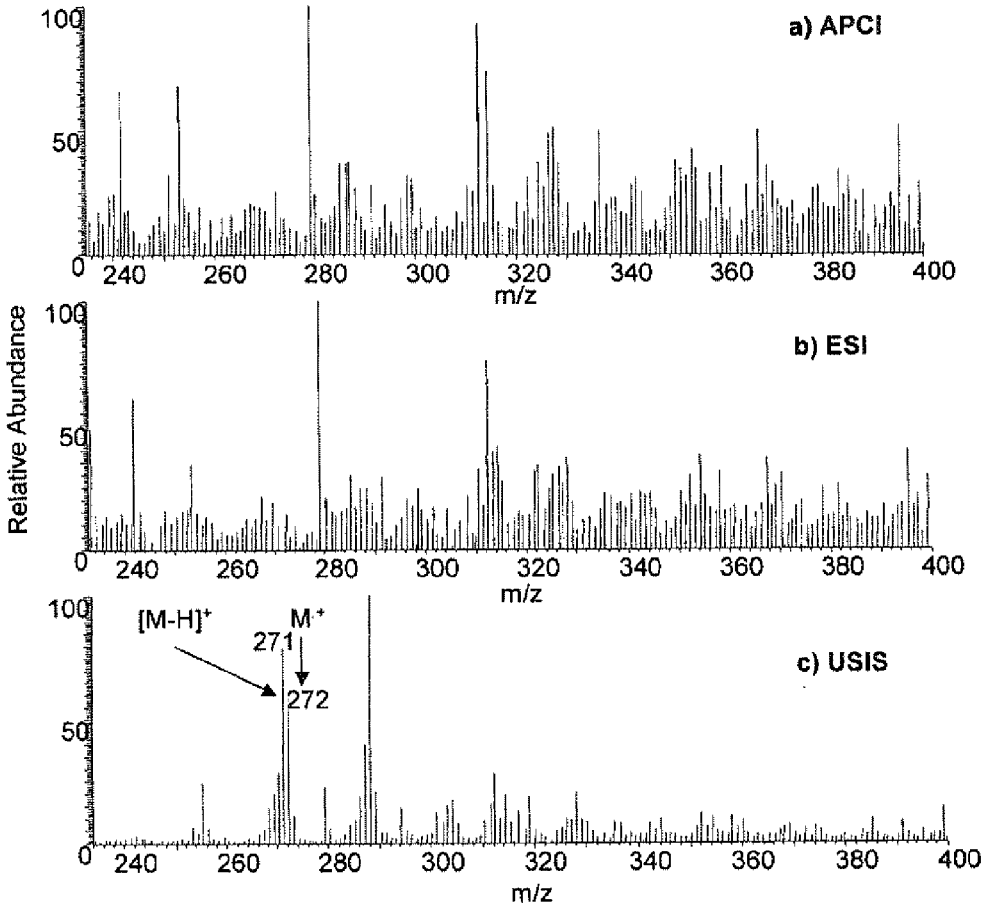

Analysis of Low Polar Compounds (e.g. Steroids etc) Not Detected by Direct Infusion Using ESI and APCI at Low Concentration Level Estradiol was analyzed using a) APCI, b) ESI and c) USIS. The direct infusion spectra were achieved using $CH_3OH$ and $CH_3CN$ as solvent (FIGS. 12*a, b*, and *c* show spectra obtained using $CH_3OH$ as solvent while FIGS. 13*a, b* and *c* show spectra obtained using $CH_3CN$ as solvent). Estradiol concentration was 50 μg/mL. The sample was solubilized using water. The direct infusion sample flow was 20 μL/min. The surface potential, electrospray needle voltage (13) and surface temperature were 50 V, 350 V and 50° C. respectively. The UV lamp was turned on while ultrasounds were turned off. The nebulizer gas flow was 2 L/min. As it can be seen no signal was obtained using ESI and APCI at this concentration level (FIGS. 12*a* and *b*; FIGS. 13*a* and *b*) while using USIS $[M.]^+$ and $[M-H]^+$ ions were clearly detected. The S/N ratio of $[M.]^+$ was 100 using $CH_3OH$ as solvent and 102 using $CH_3CN$ as solvent (FIG. 12*c* and 13*c*). It must be emphasized that the ESI soft ionization source typically gives rise to analyte $[M+H]^+$ at higher estradiol concentration level (1000 μg/mL) and using $CH_3OH$ as solvent but this signal is difficult to observe when $CH_3CN$ is employed. In the case of USIS the analyte ions are observed using both solvent ($CH_3OH$ and $CH_3CN$). This clearly showing the potential of USIS.

The invention claimed is:

1. A ionization source device for ionizing analytes in liquid phase, to be further analyzed by mass spectrometry, comprising:

(a) an inlet assembly (11) for introducing and nebulizing an analyte solution;

(b) an ionization chamber (3) in fluid communication with said inlet assembly (11) for receiving from said inlet assembly (11) the analyte solution, said ionization chamber (3) being provided with an outlet orifice (1) for communicating between the ionization chamber (3) and one of a analyzer and a filter of the mass spectrometer, (c) a plate (4) in said ionization chamber (3), having at least one active surface (4') that faces an internal aperture of the inlet assembly (11), wherein means are provided for applying and combining different physical effects to said at least one active surface (4'), said means consisting of at least two of the followings:

a power supply (26) connected to the surface (4') through electrically conductive material for one of electrically charging and polarizing the surface (4');

a power supply (26) connected to a piezoelectric apparatus for producing ultrasounds in a region of said surface (4');

one of UV-VIS, IR laser, a first lamp (21) and a second lamp (22) connected to an external power supply (27) for irradiating light onto said surface (4');

an external power supply (28) connected to a faraday box through a connector (20) for applying microwaves to the ionization chamber (3);

a closed tube (25) connected to said active surface (4') and to a pump for creating a differential pressure;

a power supply (31) for applying electric potential to electric resistances inserted in the surface (4') for heating said surface;

a power supply (31) connected to a peltier apparatus positioned on the surface (4') for cooling said surface;

whereby molecules of analyte are ionized on the active surface by the combined physical effects and focalized into a mass spectrometer analyzer entrance (1), wherein said inlet assembly (11) comprises an inlet hole (10) for feeding the analyte solution and an internal duct in fluid communication with said inlet hole (10), said internal duct comprising a nebulization region (12) and an electrically charged region (13) and ending into said ionization chamber (3), wherein at least one of said active surface (4') and the regions (12, 13) are exposed to ultrasounds at radiofrequency between 180 and 200 Hz.

2. The ionization source device according to claim 1, wherein said plate (4) is coated with a non-conductive material to form said at least one active surface (4').

3. The ionization source device according to claim 2, wherein said non-conductive material is one of a silica and a silicate derivative selected from one of glass, quartz, and a polymeric material selected from PTFE, plastic, Polyvinylchloride (PVC), Polyethylene glycol (PET).

4. The ionization source device according to claim 3, wherein said plate (4) is inclined of an angle to the axis of the assembly (11) and of the nebulizer (12) and wherein an angle of said plate (4) is changed using one of a computer and a manually controlled electronic apparatus connected to the external power supply (29).

5. The ionization source device according to claim 2, wherein said plate (4) is inclined of an angle to the axis of the assembly (11) and of the nebulizer (12) and wherein an angle of said plate (4) is changed using one of a computer and a manually controlled electronic apparatus connected to the external power supply (29).

6. The ionization source device according to claim 1, wherein said plate (4) is inclined of an angle to the axis of the assembly (11) and of the nebulizer (12) and wherein an angle of said plate (4) is changed using one of a computer and a manually controlled electronic apparatus connected to the external power supply (29).

7. The ionization source device according to claim 1, wherein said plate (4) is linked, through connecting means (5), to a handling means (6) that allows movement of said plate (4) in all directions.

8. A mass spectrometer further comprising an ionization source device as defined in claim 1.

9. The mass spectrometer according to claim 8, further comprising:

(1) a device, comprising a Liquid Chromatograph, for one of separation and de-salting of the molecules contained in a sample;

(2) at least one analyzer or filter that separates the ions according to their mass-to-charge ratio;

(3) a detector that counts a number of ions;

(4) a data processing system that calculates and plots a mass spectrum of the analyte.

10. A ionization source device for ionizing analytes in liquid phase, to be further analyzed by mass spectrometry, comprising:

(a) an inlet assembly (11) for introducing and nebulizing an analyte solution;

(b) an ionization chamber (3) in fluid communication with said inlet assembly (11) for receiving from said inlet assembly (11) the analyte solution, said ionization chamber (3) being provided with an outlet orifice (1) for communicating between the ionization chamber (3) and one of the analyzer and the filter of the mass spectrometer, (c) a plate (4) in said ionization chamber (3), having at least one active surface (4') that faces an internal aperture of the inlet assembly (11), wherein means are provided for applying and combining different physical effects to said at least one active surface (4'), said means consisting of at least two of the followings:

a power supply (26) connected to the surface (4') through electrically conductive material for one of electrically charging and polarizing the surface (4');

a power supply (26) connected to a piezoelectric apparatus for producing ultrasounds in a region of said surface (4');

one of UV-VIS, IR laser, and first lamp (21) and second lamp (22) connected to an external power supply (27) for irradiating light onto said surface (4');

an external power supply (28) connected to a faraday box through a connector (20) for applying microwaves to the ionization chamber (3);

a closed tube (25) connected to said active surface (4') and to a pump for creating a differential pressure;

a power supply (31) for applying electric potential to electric resistances inserted in the surface (4') for heating said surface;

a power supply (31) connected to a peltier apparatus positioned on the surface (4') for cooling said surface;

whereby molecules of analyte are ionized on the active surface by the combined physical effects and focalized into a mass spectrometer analyzer entrance (1), in the mass spectrometer analyzer entrance (1) microwaves with frequency between 915 and 2450 Hz are applied to evaporate a solvent of the analyte solution and ionize a sample.

11. A ionization source device for ionizing analytes in liquid phase, to be further analyzed by mass spectrometry, comprising:

(a) an inlet assembly (11) for introducing and nebulizing an analyte solution;

(b) an ionization chamber (3) in fluid communication with said inlet assembly (11) for receiving deom ionization chamber (3) the analyte solution, said ionization chamber (3) being provided with an outlet orifice (1) for communicating between the ionization chamber (3) and one of the analyzer and filter of the mass spectrometer, (c) a plate (4) in said ionization chamber (3), having at least one active surface (4') that faces an internal aperture of the inlet assembly (11), wherein means are provided for applying and combining different physical effects to said at least one active surface (4'), said means consisting of at least two of the following:

a power supply (26) connected to the surface (4') through electrically conductive material for one of electrically charging and polarizing the surface (4');

a power supply (26) connected to a piezoelectric apparatus for producing ultrasounds in a region of said surface (4');

one of UV-VIS, IR laser, and lamp (21) and (22) connected to an external power supply (27) for irradiating light onto said surface (4');

an external power supply (28) connected to a faraday box through a connector (20) for applying microwaves to the ionization chamber (3);

a closed tube (25) connected to said active surface (4') and to a pump for creating a differential pressure;

a power supply (31) for applying electric potential to electric resistances inserted in the surface (4') for heating said surface;

a power supply (31) connected to a peltier apparatus positioned on the surface (4') for cooling said surface;

whereby molecules of analyte are ionized on the active surface by the combined physical effects and focalized into a mass spectrometer analyzer entrance (1), wherein said inlet assembly (11) comprises an inlet hole (10) for feeding the analyte solution and an internal duct in fluid communication with said inlet hole (10), said internal duct comprising a nebulization region (12) and an electrically charged region (13) and ending into said ionization chamber (3), wherein temperatures of the nebulisation region (12) and of said active surface (4') are regulated through electric resistances and through peltier apparatus.

12. A method for ionizing an analyte to be analyzed by means of mass spectrometry, the method comprising the following steps:

(a) dissolving the analyte in a suitable solvent;

(b) injecting said analyte solution into a ionization source device as described in claim 1;

(c) causing the analyte solution to be nebulized;

(d) causing the nebulized analyte solution to impact onto an active surface (4');

(e) causing the ionized analyte to be collected by the analyzer or filter of a mass spectrometer, wherein ultrasound excitation is at a frequency in a range of 40-200 kHz is applied to the active surface (4') and the nebulization region (12).

13. The method according to claim 12, wherein the analyte is dissolved in a dipolar solvent selected from $H_2O$, an alcohol, acetonitrile, chloroform, tetrahydrofuran.

14. The method according to claim 12, wherein a temperature of the surface (4') is maintained between −100° C. and 700° C.

15. The method according to claim 12, wherein a potential difference between 0 and 15000 V is applied to at least on of said active surface (4') and to the nebulizer region (12).

16. The method according to claim 12, wherein the ultrasound excitation at a frequency in a range of 185-190 kHz is applied to the surface (4') and the nebulizer region (12).

17. The method of claim 16, wherein the ultrasound excitation at the frequency of 186 kHz is applied to the active surface (4') and the nebulization region (12).

18. The method according to claim 12 wherein the surface (4') is irradiated with light at a wavelength in a range between 200 nm and 10.6 μm.

19. The method according to claim wherein molecules selected from synapinic acid, dihydroxybenzoic acid, caffeic acid, a-cyano-4-hydroxycinnamic acid, are deposited on the active surface (4').

* * * * *